US010999679B1

(12) United States Patent
Savovic

(10) Patent No.: US 10,999,679 B1
(45) Date of Patent: May 4, 2021

(54) PERSONAL SOUND AMPLIFICATION SEATING

(71) Applicant: Joseph Savovic, Sherrills Ford, NC (US)

(72) Inventor: Joseph Savovic, Sherrills Ford, NC (US)

( * ) Notice: Subject to any disclaimer, the term of this patent is extended or adjusted under 35 U.S.C. 154(b) by 0 days.

(21) Appl. No.: 16/745,620

(22) Filed: Jan. 17, 2020

Related U.S. Application Data

(60) Provisional application No. 62/794,056, filed on Jan. 18, 2019.

(51) Int. Cl.
*H04R 5/02* (2006.01)
*H04R 5/027* (2006.01)

(52) U.S. Cl.
CPC ..... *H04R 5/023* (2013.01); *H04R 5/027* (2013.01); *H04R 2410/03* (2013.01)

(58) Field of Classification Search
None
See application file for complete search history.

(56) References Cited

U.S. PATENT DOCUMENTS

| | | | | |
|---|---|---|---|---|
| 4,868,888 | A * | 9/1989 | Dayton | H04R 5/023 455/575.1 |
| 6,138,040 | A * | 10/2000 | Nicholls | H04M 9/08 379/390.01 |
| 8,718,292 | B2 * | 5/2014 | Asao | G10K 11/178 381/71.4 |
| 2008/0111408 | A1 * | 5/2008 | Duran | A63F 13/98 297/217.4 |
| 2010/0104110 | A1 * | 4/2010 | Asao | B64C 1/40 381/71.3 |
| 2017/0027271 | A1 * | 2/2017 | Ferencz | G09B 5/04 |
| 2017/0150264 | A1 * | 5/2017 | Nelson | A61H 23/0236 |
| 2017/0186417 | A1 * | 6/2017 | Maeda | H04R 1/025 |
| 2018/0297488 | A1 * | 10/2018 | Lem | B60N 2/0244 |

* cited by examiner

*Primary Examiner* — Paul W Huber
(74) *Attorney, Agent, or Firm* — Tuggle Duggins P. A.; Blake P. Hurt

(57) ABSTRACT

A personal sound amplification seating solution including integrated microphones, speakers, and a hand-operated-remote is disclosed. By detecting audio inputs from up to three (3) meters away, passing the audio inputs through a printed circuit board, and broadcasting the audio through personalized speakers proximate the user's ears, conversations and entertainment options such as television shows and movies can be accessed by those with reduced hearing functionality without need for increased volume.

5 Claims, 5 Drawing Sheets

PERSONAL SOUND AMPLIFICATION SEATING

FIELD OF THE INVENTION

The invention herein pertains to furniture generally, and particularly pertains to specialized seating solutions with integrated audio components including microphones and speakers, to amplify desirable sound in the surrounding environment.

DESCRIPTION OF THE PRIOR ART AND OBJECTIVES OF THE INVENTION

Hearing loss is a serious and increasing condition that may go undiagnosed for months or even years. The Hearing Loss Association of American estimates that 48 million people in the United States suffer from some form of hearing loss in one or both ears. Hearing aids have become a popular solution to offset loss of hearing, but they are expensive, prone to misfitting, and require replacement batteries or complex recharging systems that can render the aid frustrating or even useless. There are also several hours throughout the day that one may not require the use of a hearing aid, even if they are living with hearing loss. That said, it is often desirable to have an audio aid in certain circumstances, such as when participating in a conversation or watching a television. Turning up the volume on a television may impair the viewing enjoyment of others, and does nothing to aid the hearing loss patient from participating in conversations while the television is on. Hearing aids have made great technological strides in modulating their operation to accommodate different types of audiological inputs, but they still struggle in mixed sound environments. Other entertainment solutions include wired or wireless speakers installed in the furniture, which are acceptable for providing an individualized experience as far as the entertainment is concerned, but can be isolating as they drown out even the possibility of carrying on a conversation with another party due to the source of the audio input coming directly from the output device such as a television.

Thus, in view of the problems and disadvantages associated with prior art devices, the present invention was conceived and one of its objectives is to provide a system and method of providing entertainment audio in an individualized capacity to someone without compromising the user's ability to participate in conversation.

It is another objective of the present invention to provide a seating solution that can provide audio output to a single user without increasing the volume output of the entertainment device.

It is still another objective of the present invention to provide a seating solution that can detect audio inputs via one or more microphones and present them as output to one or more speakers directed at a user seated in the seating solution.

It is yet another objective of the present invention to provide a seating solution with a pair of high gain miniature microphones integrated therein, the microphones in communication with different ones of a pair of high definition speakers, the microphones configured to eliminate feedback in the speaker output.

It is a further objective of the present invention to provide a seating solution with a stand-alone (i.e. no wired or wireless connectivity to an entertainment device) ability to amplify entertainment and ambient sound in an environment without use of headphones for a user.

It is still a further objective of the present invention to provide a seating solution with a hand-operating control.

It is yet a further objective of the present invention to provide a seating solution selected from a group comprising chairs, recliners, lift chairs, loveseats, sofas, vehicle seats, and movie theater seats.

Various other objectives and advantages of the present invention will become apparent to those skilled in the art as a more detailed description is set forth below.

SUMMARY OF THE INVENTION

The aforesaid and other objectives are realized by providing a specialized, upholstered seating solution with electronic components deployed to create an individualized audio environment for a user seated therein. Specifically, the seating solution defines a seat base attached at opposing lateral sides to a pair of vertically extending arm portions and along a longitudinally extending side to a vertically extending back portion. Mounted to the back portion at a position opposite that of the base are one or more speakers directionally oriented such that their respective output is substantially aimed in the direction of a midline at a user seated on the seat base, such a configuration referred to as near field sound. Each speaker includes an audio output in communication with an audio input device configured to detect undesirable audio impetuses in an effort to eliminate back feed. Integrated into each of the arm portions are at least one aft-facing microphone configured to detect audio inputs captured from the surrounding environment. The speakers and the microphones are each in electronic communication with a digitally printed circuit board (PCB), whereby the audio inputs detected by the microphone(s) are communicated for output by the speakers to enhance the audio experience of the user of the seating solution without needing to increase the "local" volume of the entertainment devices such as a television, radio, or the like. The various electronic components can be controlled by a control device in communication with the aforementioned PCB, and may include additional functionality such as reclining, massaging, extension of a leg rest, and lifting features of the chair if such structural components are associated therewith.

DETAILED DESCRIPTION OF THE PREFERRED EMBODIMENT AND OPERATION OF THE INVENTION

Figure 1:
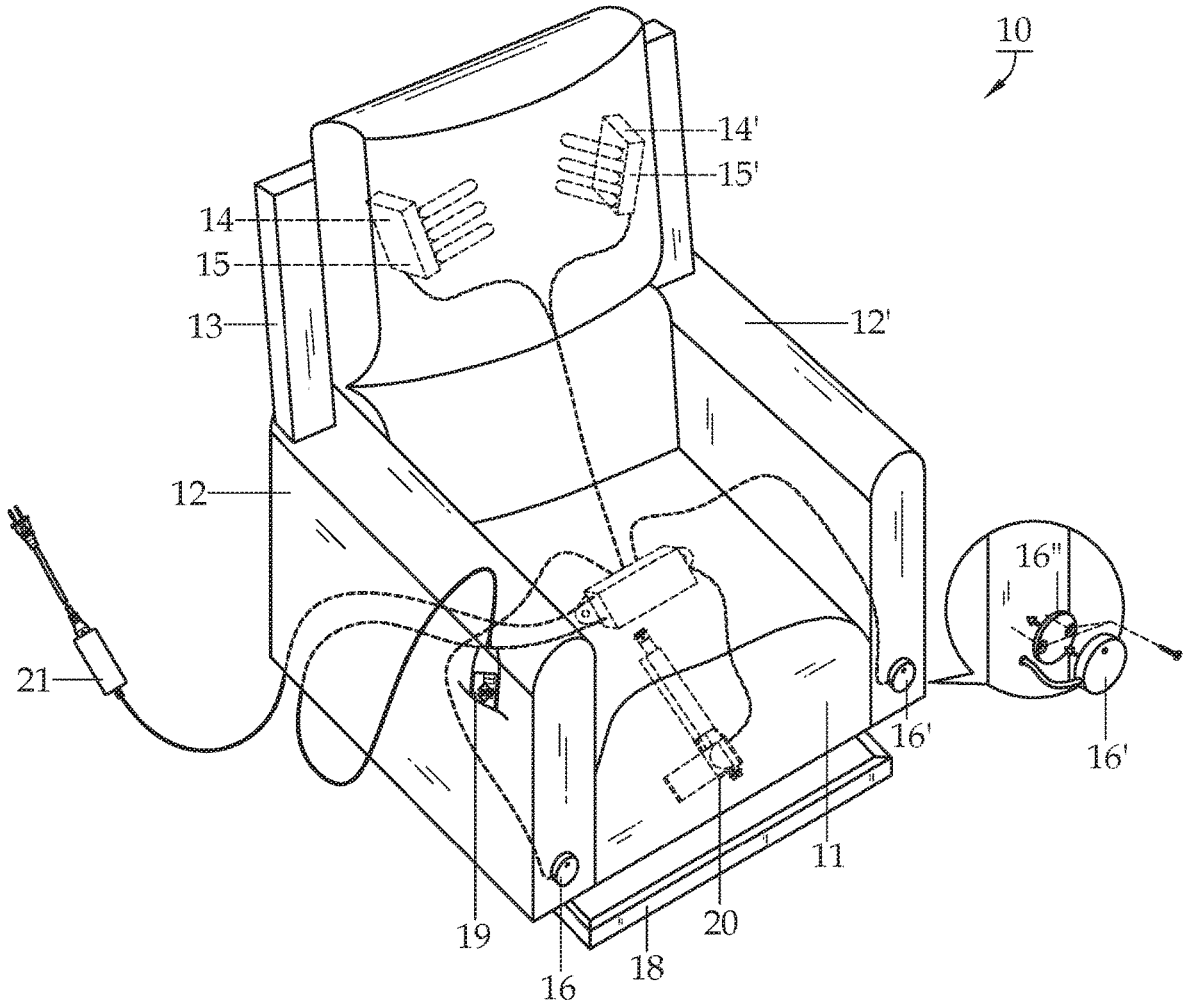
FIG. 1 shows an elevated perspective view of a schematic of the seating solution disclosed herein.

Various exemplary embodiments of the present disclosure are described below. Use of the term "exemplary" means illustrative or by way of example only, and any reference herein to "the invention" is not intended to restrict or limit the invention to exact features or step of any one or more of the exemplary embodiments disclosed in the present specification. References to "exemplary embodiment", "one embodiment", "an embodiment", "various embodiments", and the like may indicate that the embodiment(s) of the invention so described may include a particular feature, structure, or characteristic, but not every embodiment necessarily incudes the particular feature, structure, or characteristic. Further, repeated use of the phrase "in one embodiment", "in an exemplary embodiment", or "in an alternative embodiment" do not necessarily refer to the same embodiment, although they may.

It is also noted that terms like "preferably", "commonly", and "typically" are not utilized herein to limit the scope of the invention or to imply that certain features are critical, essential, or even important to the structure or function of the invention. Rather, these terms are merely intended to highlight alternative or additional features that may or may not be utilized in a particular embodiment of the present invention.

The present invention is described more fully hereinafter with reference to the accompanying figures, in which one or more exemplary embodiments of the invention are shown. Like numbers used herein refer to like elements throughout. The invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limited as to the scope of the invention, and any and all equivalents thereof. Moreover, many embodiments such as adaptations, variations, modifications, and equivalent arrangements will be implicitly disclosed by the embodiments described herein and fall within the scope of the instant invention.

Although specific terms are employed herein, they are used in a generic and descriptive sense only and not for the purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. Where only one item is intended, the terms "one and only one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has previously been reduced to practice or that any testing has been performed. Likewise, unless stated otherwise, use of verbs in the past tense (present perfect or preterit) is not intended to indicate or imply that the invention has previously been reduced to practice or that any testing has been performed.

Figure 2:
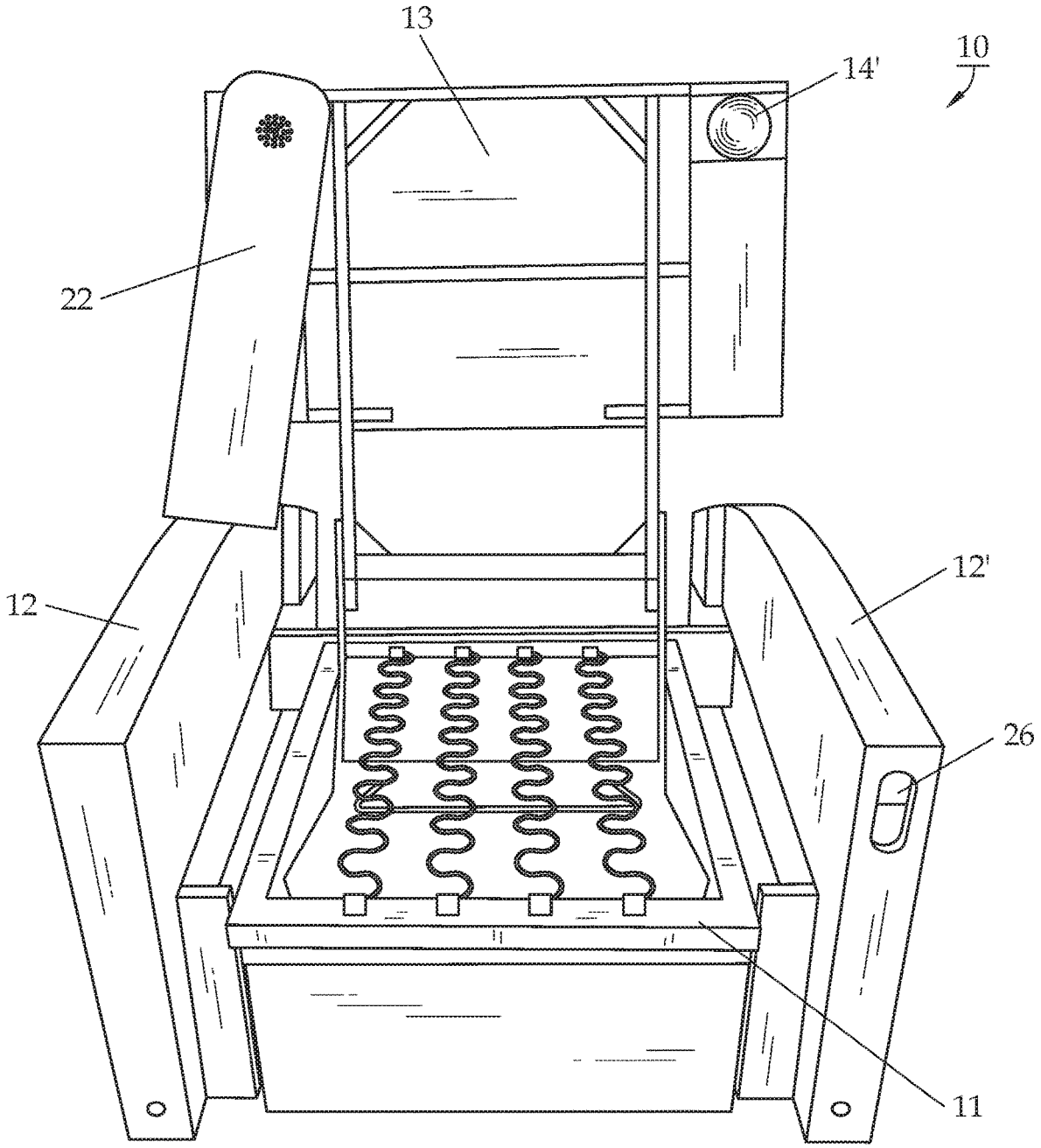
FIG. 2 pictures an elevated perspective picture of the seating solution of FIG. 1.

For a better understanding of the invention and its operation, turning now to the drawings, FIGS. 1-2 illustrate the preferred embodiment of improved seating solution 10. Throughout the description and the illustrations, seating solution 10 is represented as a species of chair, but it should be noted that the specific style and functionality (i.e. static, reclining, rocking, lifting, etc.) should not be construed as a limitation on the instant invention. Further, it should be understood that the term "seating solution" should be broadly construed to encompass (without limitation) chairs, seats, love seats, benches, sofas, couches, and the like, both free-standing and incorporated into larger structures such as but not limited to built-ins, cars, trucks, boats, and movie theaters. In the preferred embodiment, seating solution 10 includes a generally horizontal base 11, one or more arms 12, 12', and a back 13. As would be understood, arms 12, 12' are affixed at opposing lateral sides of base 11 and back 13 is attached to the adjoining side relative to arms 12, 12', either in a static or pivoting manner. As illustrated in FIG. 2, the preferred embodiment of seating solution 10 may include a pivoting attachment, allowing back 13 to recline as desired utilizing mechanical structure as known in the art. The reclining action may be driven by mechanical or electronic methods as will be described in further detail below.

Figure 3:
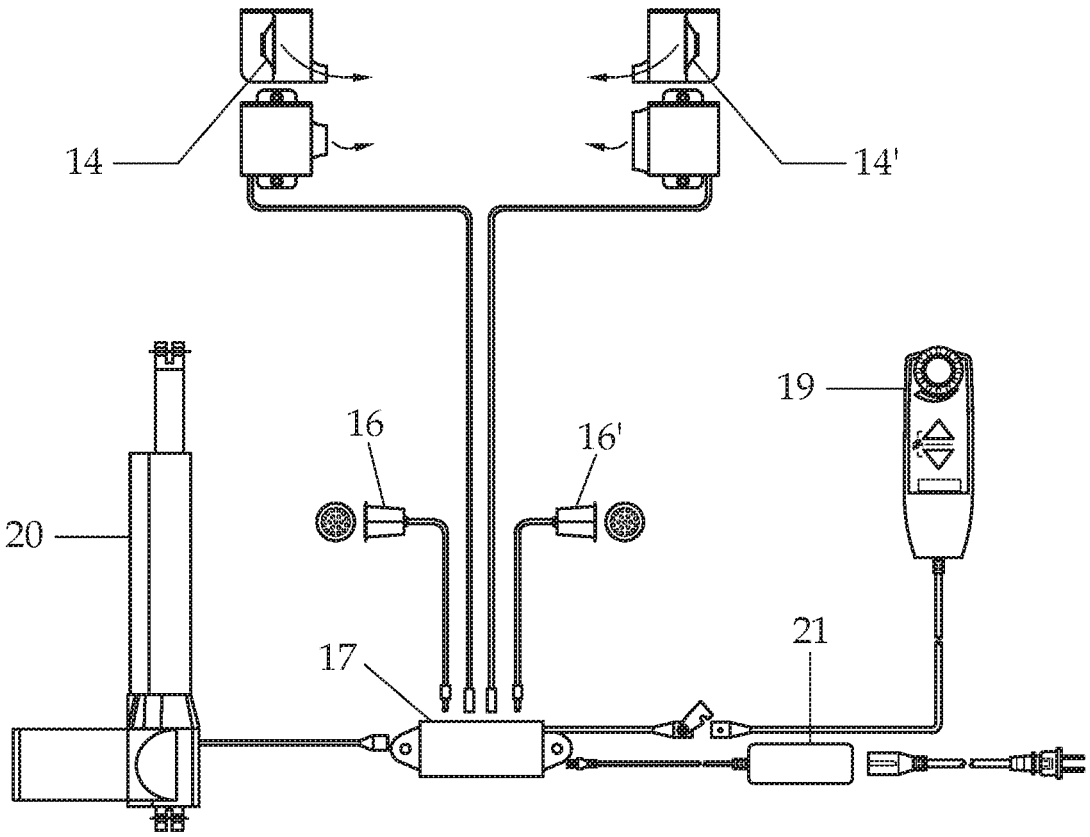
FIG. 3 demonstrates a schematic diagram of the components of the seating solution of FIG. 1.
Figure 4:
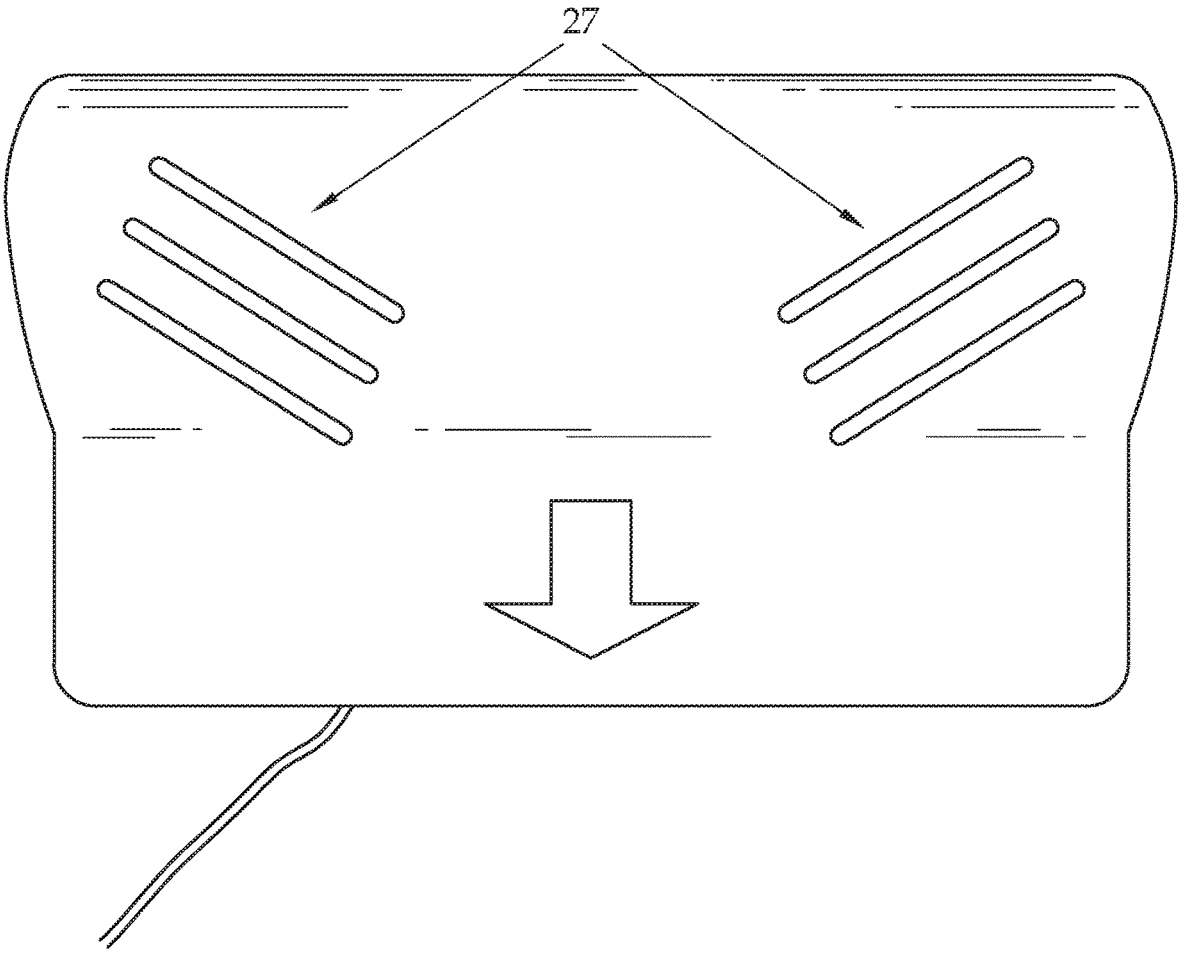
FIG. 4 illustrates a front perspective view of the head of the seating solution of FIG. 1.
Figure 5:
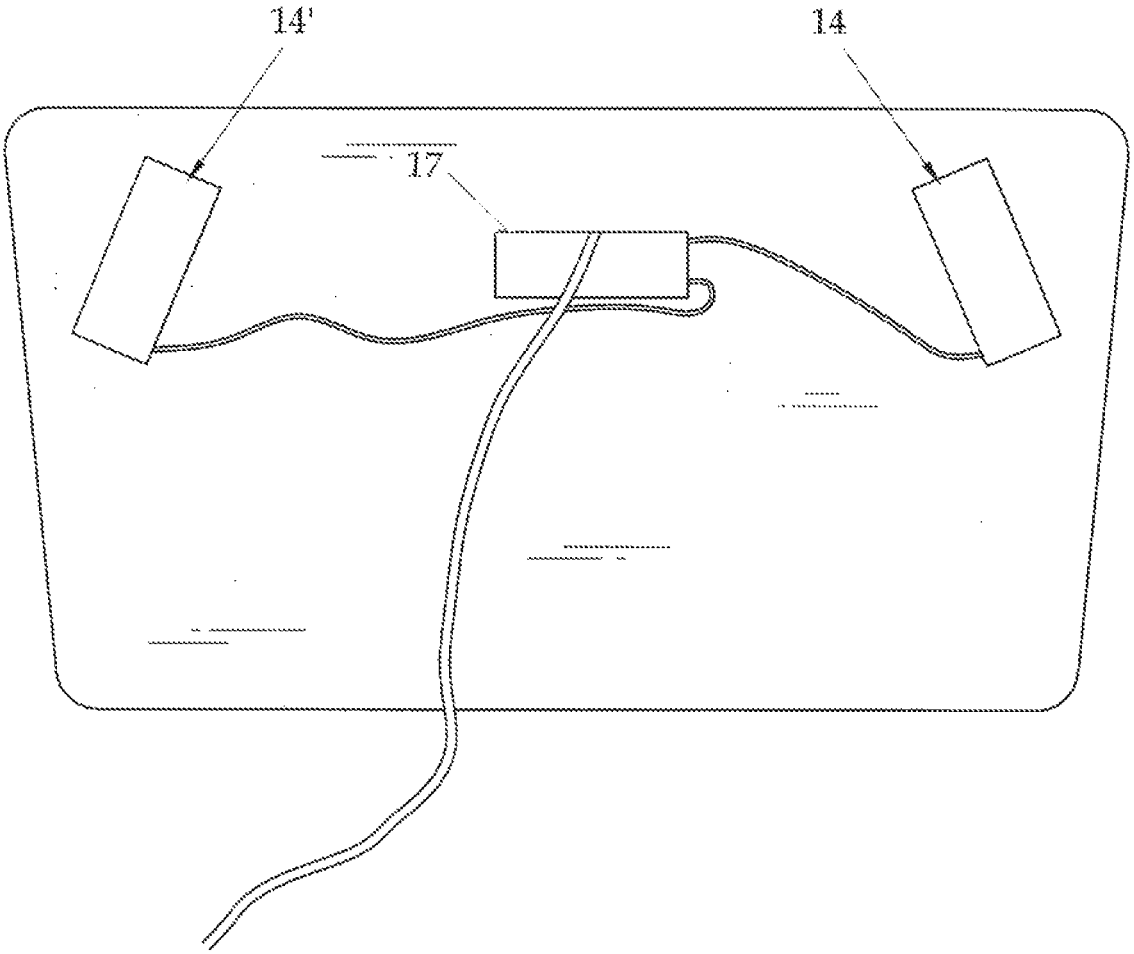
FIG. 5 shows a rear perspective view of the head of the seating solution of FIG. 1.

As demonstrated schematically in FIGS. 1 and 3, an embodiment of seating solution 10 includes one or more speakers 14, 14' carried by back 13. In the preferred embodiment, a pair of speakers 14, 14' (FIG. 5) are attached to back 13 at generally the opposite end of back 13 relative to base. 11, with the audio outputs oriented in an inward direction towards the midline of seating solution 10, preferably in a configuration known as near field sound. Alternative embodiments need not orient the output of speakers 14, 14' in the direction of the user, but such a configuration is desirable as described in further detail below. Also, one or more alternative embodiments of speakers 14, 14' may be mounted to a movable, bendable, or otherwise deformable version of a head portion of seating solution 10, such that the specific orientation of the speakers 14, 14' may be altered for the pleasure of a user (not shown). It is permissible to utilize a wide range of speakers for the stated purpose, but the preferred species of speaker is available commercially as a "high definition" speaker species, particularly a speaker configured for near field use. The term "high definition" refers to the range of inputs a speaker can accommodate, and is typically contrasted by the concept of volume on the output side of a speaker. However, whereas the metric of volume may generally be defined by loudness, definition reflects a metric more akin to clarity. Therefore, it is preferable in the instant disclosure to utilize speakers that not only facilitate high volume, but also high clarity, thus high definition. Generally, a high definition speaker has an output of audio with greater than 44.1 kHz sample rate and/or higher than 16-bit linear bit depth (also sometimes referred to as a high resolution speaker). Additionally, or in the alternative, preferred speakers 14, 14' also include one or more noise cancelling microphones 15, 15' incorporated therewith. Acoustic feedback occurs when the amplified sound from any loudspeaker re-enters the sound system through any open microphone and is amplified again and again and again. As will be described in greater detail below, microphones 16, 16' (FIG. 1) are responsible for detecting the audio inputs that are ultimately distributed by speakers 14, 14', so it is beneficial for microphones 15, 15' to be deployed in an effort to detect and reduce back feed through the system (a process also known as "noise cancelling"). In the preferred embodiment, speakers 14, 14' are encased in a foam to provide added comfort to the user. Species of foam include, but are not limited to, reticulated foam, gel foam, memory foam, open cell foam, closed cell foam, and the like. Some embodiments may include one or more directional openings 27 (FIG. 4) to facilitate a desirable auditory experience for the user, either in the foam, the upholstery, or any other exterior covering of speakers 14, 14'. These openings 27 allow the sound to come out and may intentionally be placed on an inward angle, which will allow any users seating position, height, or head position to optimize the sound delivery. One embodiment of seating solution 10 includes a zipper enclosure (not shown) that protects speakers 14, 14' from exterior contact. One or more additional enclosures may further be used to separate the speakers 14, 14' from the foam padding in the storage portion of seating solution 10.

Seating solution 10 also preferably includes one or more microphones 16, 16' positioned on each of arms 12, 12'. In the preferred embodiment, a pair of microphones 16, 16' are attached to different ones of arms 12, 12' at the opposing end of said arms relative to back 13. One embodiment orients the respective microphones 16, 16' on the outward facing surface of corresponding arms 12, 12'. As seen in FIG. 2, an opening or hole 26 is formed in arm 12' for placement of microphone 16' and a mounting plate or cover 16" in FIG. 1 demonstrates an exploded view. It should be noted that the placement of hole 26 may vary and is not considered a limitation of the instant invention. It is permissible to utilize a wide range of microphones for the stated purpose, but similar to speakers 14, 14' described above, the preferred species of microphone is available commercially as a "high gain" microphone species, providing the clearest audio capture for transmission to speakers 14, 14'. In use, microphones 16, 16' are the introductory point for audio inputs from the surrounding environment that the user of seating solution 10 may wish to hear. By capturing these inputs from a forward position, electronically amplifying the sounds, and then projecting them in close proximity to (and in the direction of) the user, seating solution 10 can facilitate the participation of said user in entertainment and conversation that would otherwise be beyond the user due to auditory deficiencies.

Embodiments of speakers 14, 14' and microphones 16, 16' are in communication with electronic control module 17. The various components of seating solution 10 are demonstrated as being connected with electronic control module 17 via wires in FIGS. 1 and 3, but this is not considered to be a requirement of the instant invention, and wireless embodiments are equally considered within the scope of the disclosure. In the preferred embodiment, electronic control module 17 is defined as a printed circuit board (PCB) configured (i.e. sized, shaped, and programmed) to process audio inputs received at microphones 16, 16', boosted, clarified, or otherwise processing those inputs, and then transmitting them for output at speakers 14, 14'. This functionality allows the user to hear conversations at a spoken decibel from up to three (3) meters away without the need of electronic or wireless connection and/or accessory. In one or more embodiments, electronic control module 17 may further include a balance knob or switch (not shown) that can instruct the electronic control module 17 to send balanced audio outputs to the right and left speakers 14, 14' respectively, or can increase the audio output in one of the left or right speakers 14, 14' respectively. This function is particularly beneficial for a population that routinely has one ear that is more operative than the other. Additionally, or in the alternative electronic control module 17 may additionally include a feedback knob or switch (not shown) to reduce the occurrence of feedback or audio echo.

The preferred embodiment of seating solution 10 includes accessories for functionality beyond the acoustic amplification. For example, seating solution 10 may include an elevation feature facilitated by lift 18 built into the base of seating solution 10. Control 19 may be in communication with electronic control module 17 to control all audio inputs and outputs, but also to allow the user to control extension or retraction of lift 18 via lifting piston 20. As discussed above, seating solution 10 may include back 13 pivotally attached to chair base 11 to facilitate reclining motion, a functionality that may be controlled by control 19 or engaged manually as would be understood by one in the art (not shown). Additionally, or in the alternative, additional accessory features such as heating, cooling, vibration/massage, and/or leg rest extension and retraction may also be included herein. Although not described here for the sake of brevity, it should be understood that requisite power supply 21 and all necessary hardware is contemplated within the scope of the instant invention.

Throughout the figures seating solution 10 is presented as a piece of furniture that may be upholstered. The assembly process includes securely mounting the lift 18 to the bottom of the chair base 11 and installing electronic control module 17 along with the conventional structural supports for seating furniture such as springs, straps, or the like within chair base 11. Arms 12, 12' are attached to chair base 11, connecting microphones 16, 16' to said arms and connecting control 19 to electronic PCB 17. Speakers 14, 14' with noise cancelling microphones 15, 15' are attached to back 13 and connected to form the bones of seating solution 10. In this way, the present invention utilizes a plurality of discrete, high gain microphones 16, 16' to receive ambient sound in a room or other defined environment from up to three (3) meters away without needing to be wired or wirelessly connected to another device. The sound input(s), which may originate from an entertainment source such as a television or a spoken conversation by one or more third parties, are processed through electronic PCB 17 and transmitted to noise cancelling microphones 15, 15' positioned in proximity to the user's ears, underneath the upholstery and perforated upholster panels 22 (only one shown in FIG. 2) that offer a smooth, discrete design aesthetic. The user has the ability to hear spoken and broadcast conversation, and if the user suffers from a hearing deficiency, the user need only engage control 19 to amplify and increase the speaker output, without need for adjusting the television or asking others to speak up.

Additionally, or in the alternative in relation to seating solution 10 as described above, seating solution 10 may further include a wireless connection interface that offers connectivity to one or more wireless technology standard(s) for exchanging data between fixed and mobile devices over short distances. By way of example, but not to be construed as a limitation, Bluetooth™ is a wireless technology standard used for exchanging data between fixed and mobile devices over short distances using short-wavelength UHF radio waves in the industrial, scientific and medical radio bands, from 2.400 to 2.485 GHz, and building personal area networks. Seating solution 10 may be capable of sending and receiving data in a wireless manner using protocols like the Internet Protocol, or IP, and a wireless application protocol such as WAP. This allows users to access information via wireless devices, such as smart phones, mobile phones, pagers, two-way radios, communicators, and the like. Wireless data access is supported by many wireless networks, including, but not limited to, CDPD, CDMA, GSM, PDC, PHS, TDMA, FLEX, ReFLEX, iDEN, TETRA, DECT, DataTAC, Mobitex, EDGE and other 2G, 3G, 4G, 5G and LTE technologies, and it operates with many hand-held device operating systems, such as PalmOS, EPOC, Windows CE, FLEXOS, OS/X, JavaOS, iOS and Android. This functionality means that the audiological capabilities described above may also cooperatively operate with smart televisions as well as other wirelessly connected devices. It also permits the user of seating solution 10 to make and receive phone calls from a properly configured cell phone.

The illustrations and examples provided herein are for explanatory purposes and are not intended to limit the scope of the appended claims.

I claim:

1. A seating solution for an enhanced entertainment experience by a user who is hard of hearing, the seating solution comprising, a seat base attached at opposing first and second sides to a pair of arm portions and along a third side to a back portion, the pair of arm portions extending vertically relative to a top of the seat base and the back portion extends vertically relative to a top of the seat base, the seat base including a pivoting attachment configured to recline the back portion relative to the seat base a high definition speaker with a noise-cancelling microphone integrated therein mounted to the back portion at a position opposite that of the seat base, the high definition speaker encased in a layer of foam defining one or more openings in the foam, whereby the high definition speaker and the one or more openings in the foam are oriented on a bias to direct an audio output towards a midline of the seating solution, a high gain microphone configured to detect one or more audio inputs captured from a surrounding environment, the high gain microphone positioned within a hole on an outward facing surface of one of the pair of arm portions, and an electronic control module defined as a printed circuit board with a knob control in communication with the speaker and the high gain microphone, the printed circuit board configured to process the one or more audio inputs received by the high gain microphone, whereby the one or more audio inputs detected by the high gain microphone are communicated for output by the speaker to enhance the audio experience of the user of the seating solution without needing to increase a volume of an entertainment device, defining functionality permitting the user to hear conversations at a spoken decibel up to three meters away.

2. The seating solution of claim 1 further comprising a lift attached to the base.

3. The seating solution of claim 2 further comprising a control in communication with the electronic control module and configured to operate the base.

4. A seating solution for an enhanced entertainment experience by a user who is hard of hearing, the seating solution consisting of, a seat base attached at opposing lateral sides to a pair of arm portions extending vertically relative to a top surface of the seat base, and along a longitudinally extending side to a back portion extending vertically relative to the top surface of the seat base, the seat base including a pivoting attachment configured to recline the back portion relative to the seat base, a pair of high definition speakers each mounted to the back portion at a position opposite that of the seat base, the pair of high definition speakers positioned opposite of one another, each of the pair of high definition speakers with a noise-cancelling microphone integrated therein, each of the pair of high definition speakers encased in a layer of foam defining one or more openings in the foam, whereby the high definition speaker and the one or more openings in the foam are oriented on a bias to direct an audio output towards a midline of the seating solution a pair of high gain microphones configured to detect one or more audio inputs captured from a surrounding environment, one of the pair of high gain microphones positioned on different ones of the arm portions and within a hole on an outward facing surface of one of the pair of arm portions, and an electronic control module defined as defined as a printed circuit board with a knob control in communication with the pair of high definition speakers and the pair of high gain microphones, the printed circuit board configured to process the one or more audio inputs received by one or more of the high gain microphones whereby the one or more audio inputs detected by one or both of the high gain microphones are communicated for output by one or both of the high definition speakers to enhance the audio experience of the user of the seating solution without needing to increase a volume of an entertainment device, defining functionality permitting the user to hear conversations at a spoken decibel up to three meters away.

5. The seating solution of claim 4 further comprising an electronic control and a lift attached the base, the electronic control configured to operate the base, and both the electronic control and the base in communication with the electronic control module.

* * * * *